US006595441B2

(12) United States Patent
Petrie et al.

(10) Patent No.: US 6,595,441 B2
(45) Date of Patent: Jul. 22, 2003

(54) MIXING CUP ADAPTING ASSEMBLY

(75) Inventors: Robert M. Petrie, Plymouth, MN (US); Stephen C. P. Joseph, Hartshill (GB); Keith C. Navis, White Bear Lake, MN (US); David C. Roeker, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/139,887

(22) Filed: May 6, 2002

(65) Prior Publication Data

US 2002/0134861 A1 Sep. 26, 2002

Related U.S. Application Data

(63) Continuation of application No. 09/374,794, filed on Aug. 16, 1999.

(51) Int. Cl.[7] ..... B05B 7/30

(52) U.S. Cl. ..... 239/345; 239/318; 239/340; 239/74

(58) Field of Search ..... 285/360, 376, 285/401; 239/345, 340, 337, 347, 350, 318, 378, 74; 222/189.06, 481, 158; 141/383, 346, 385, 384

(56) References Cited

U.S. PATENT DOCUMENTS

| | | | | |
|---|---|---|---|---|
| 856,361 A | | 6/1907 | Nelburg | |
| 1,476,666 A | | 12/1923 | Agnew, Sr. | |
| 2,263,843 A | | 11/1941 | Gross | |
| 2,612,404 A | * | 9/1952 | Andersson | 239/345 |
| 2,770,706 A | | 11/1956 | Vogtle et al. | |
| 2,901,182 A | | 8/1959 | Cragg et al. | |
| 4,411,397 A | | 10/1983 | Stern et al. | |
| 4,773,569 A | | 9/1988 | Larson | |
| 4,811,904 A | | 3/1989 | Ihmels et al. | |
| 4,946,075 A | | 8/1990 | Lundback | |
| 4,993,639 A | | 2/1991 | Hata | |
| 5,069,389 A | | 12/1991 | Snetting et al. | |
| 5,271,683 A | | 12/1993 | Snetting | |
| 5,601,212 A | * | 2/1997 | Lee | 222/205 |
| 5,803,367 A | | 9/1998 | Heard et al. | |
| 6,165,159 A | | 12/2000 | Blanton | |
| 6,302,445 B1 | * | 10/2001 | Kugele et al. | 285/360 |

FOREIGN PATENT DOCUMENTS

| | | | |
|---|---|---|---|
| CH | 653-574 A | | 1/1986 |
| DE | 2412743 A | | 1/1975 |
| WO | WO 98/32539 | * | 7/1998 |

* cited by examiner

*Primary Examiner*—Michael Mar
*Assistant Examiner*—Christopher Kim
(74) *Attorney, Agent, or Firm*—William L. Huebsch

(57) ABSTRACT

An assembly for feeding liquid to the inlet port of a gravity feed sprayer. The assembly includes (1) a mixing cup of a known type commonly used to mix paint with solvent that is of stiff polymeric material and bears indicia on its side wall indicating the levels to which a plurality of different liquids should be sequentially poured into the cup to achieve a predetermined ratio between the liquids; (2) a first adapter comprising a central portion having a through opening and a transverse portion including a peripheral part defining a groove along its inner surface adapted for sealing engagement with a top end of the mixing cup; and (3) a second adapter having a through opening, a first end portion of which second adapter is adapted to releasably engage the inlet port of a gravity feed paint sprayer. A second end portion of the second adapter and the central portion of the first adapter have connector parts adapted for releasable liquid tight engagement between the adapters with their through openings in communication.

5 Claims, 4 Drawing Sheets

MIXING CUP ADAPTING ASSEMBLY

CROSS REFERENCE TO RELATED APPLICATION

This application is a continuation of U.S. patent application Ser. No. 09/374,794 filed Aug. 16, 1999.

FIELD OF THE INVENTION

The present invention relates to the liquid supply assemblies for gravity fed liquid (e.g., paint) spraying devices or spray guns.

BACKGROUND OF THE INVENTION

Various liquid supply assemblies have been described for use with gravity fed liquid (e.g., paint) spraying devices or spray guns, including those described in the international application published as International Publication Number WO 98/32539 on Jul. 30, 1998, the content whereof is incorporated herein by reference. The supply assembly including a collapsible liner that is described and claimed in that application should provide advantages over the prior art liquid supply assembly also described in that application.

DISCLOSURE OF THE INVENTION

The present invention provides a liquid supply assembly for use with gravity fed liquid spraying devices that, like the liquid supply assembly described and claimed in WO 98/32539, should also provide advantages over the prior art liquid supply assembly described in that application.

According to the present invention there is provided a liquid supply assembly adapted for use on a gravity fed liquid spraying device that comprises (1) a mixing cup of stiff polymeric material that bears indicia on its side wall indicating the levels to which a plurality of different liquids should be sequentially poured into the cup to achieve a predetermined ratio between the liquids; (2) a first adapter comprising a central portion having a through opening and a transverse portion including a peripheral part defining a groove along its inner surface adapted for sealing engagement with a top end of the mixing cup; (3) a second adapter having a through opening, a first end portion adapted to releasably engage the inlet port of the spraying device; and a second end portion having a connector part adapted for releasable liquid tight engagement with a connector part on the central portion of the first adapter with the through openings in communication.

The mixing cup is of a known type commonly used in paint shops to mix different paints and/or to mix paint with solvent. Those liquids are mixed using indicia on the side walls of the mixing cup. That indicia indicates the levels to which two or three different liquids should be sequentially poured into the mixing cup to provide a predetermined ratio between those liquids, such indicia being provided for a plurality of different ratios. Prior to this invention, liquid from the mixing cup was poured into a liquid supply assembly for a spray gun, and if liquid remained after the spraying operation was complete, that remaining liquid was sometimes poured back into the mixing cup, an air tight cover was applied thereto, and the liquid (e.g., paint) was stored for future use in the covered mixing cup.

The present invention affords further use of that mixing cup as part of the liquid supply assembly for the spraying device. This eliminates the need to pour the mixed liquid (e.g., paint) out of the mixing cup prior to spraying, or to pour unsprayed liquid back into the mixing cup after the spraying operation. Instead, the liquid is mixed in the mixing cup, remains in the mixing cup during the spraying operation when the mixing cup becomes part of the liquid supply assembly for the spraying device, and if unsprayed liquid remains after the spraying operation, it can be retained in the mixing cup which is then separated from the rest of the liquid supply assembly and can have a conventional air tight cover applied to it for storage.

A vacuum relief for the liquid supply assembly can be provided by inserting a tapered removable pin (e.g., a pin of the type sometimes called a "push pin") through the side wall of the mixing cup adjacent its bottom wall. That pin is removed during use of the mixing cup in the liquid supply assembly for the spraying device when the mixing cup is positioned with its bottom wall uppermost so that air can enter the cup through an air passageway formed by the pin above the liquid being supplied to the spraying device. Before and after the spraying operation when the cup is supported on its bottom wall that pin may be positioned in the passageway it forms to preclude liquid leaking out of the mixing cup through that passageway.

The liquid supply assembly can also include a removable filter assembly for filtering liquid leaving the mixing cup during the spraying operation.

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 5:
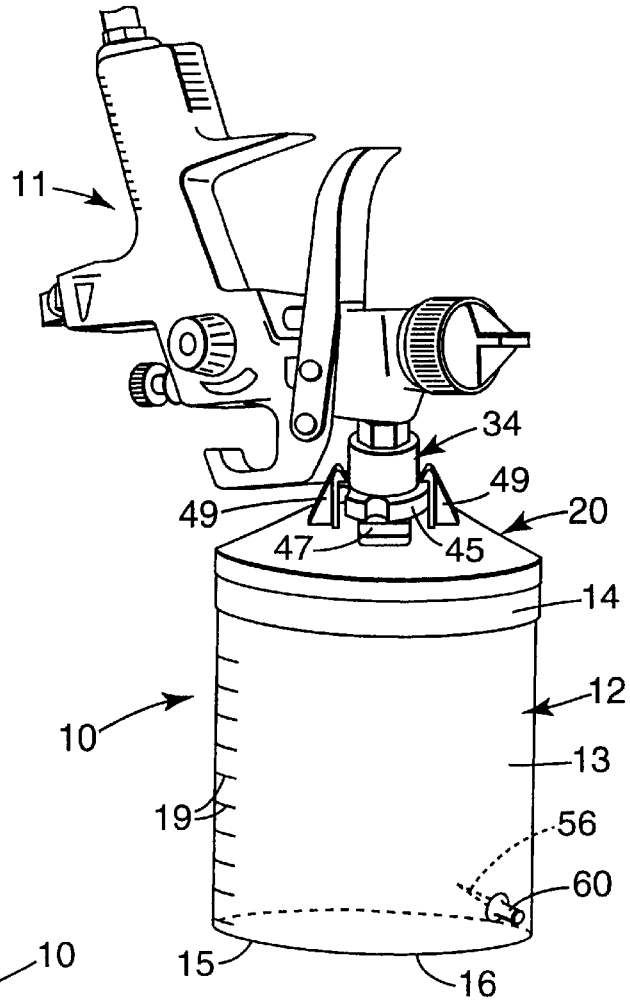
FIG. 5 is a perspective view of the liquid supply assembly of FIG. 1 attached to an inverted spraying device or spray gun.
Figure 6:
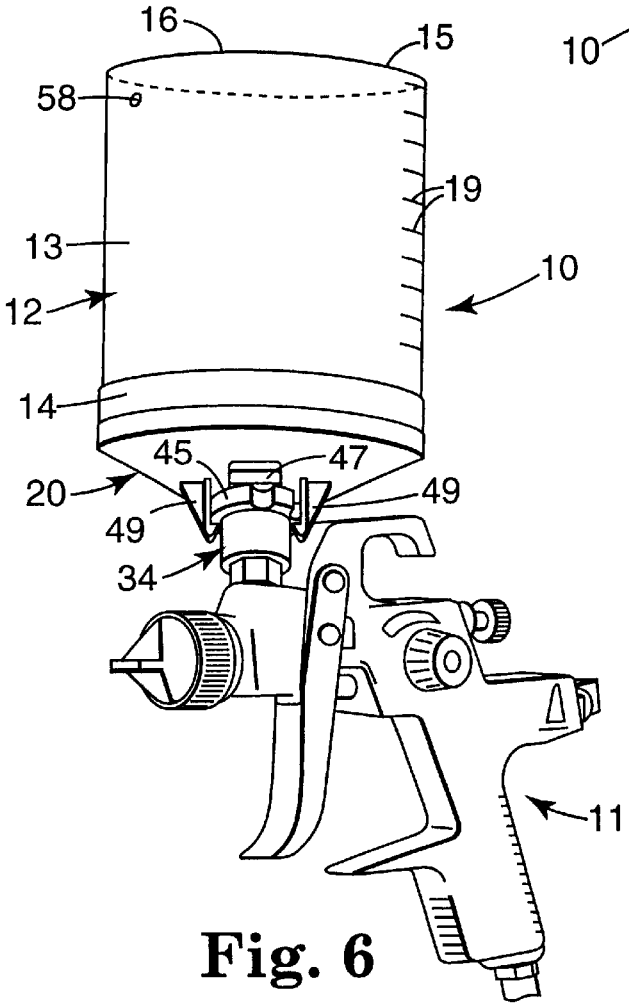
FIG. 6 is a perspective view of the liquid supply assembly of FIG. 1 attached to the spraying device as in FIG. 5 and inverted to the position used for spraying liquid with the spraying device.

Referring now to the drawing there is illustrated a liquid supply assembly according to the present invention generally designated by the reference numeral 10. That liquid supply assembly 10 (as is illustrated in FIGS. 3, 5 and 6) can be used to supply liquid for a conventional gravity fed liquid spraying device or spray gun 11 (e.g., the spray gun commercially designated NR 95 that is available from Sata, Farbspritzechnik GmbH & Co., Kornwestheim, Germany.

Figure 1:
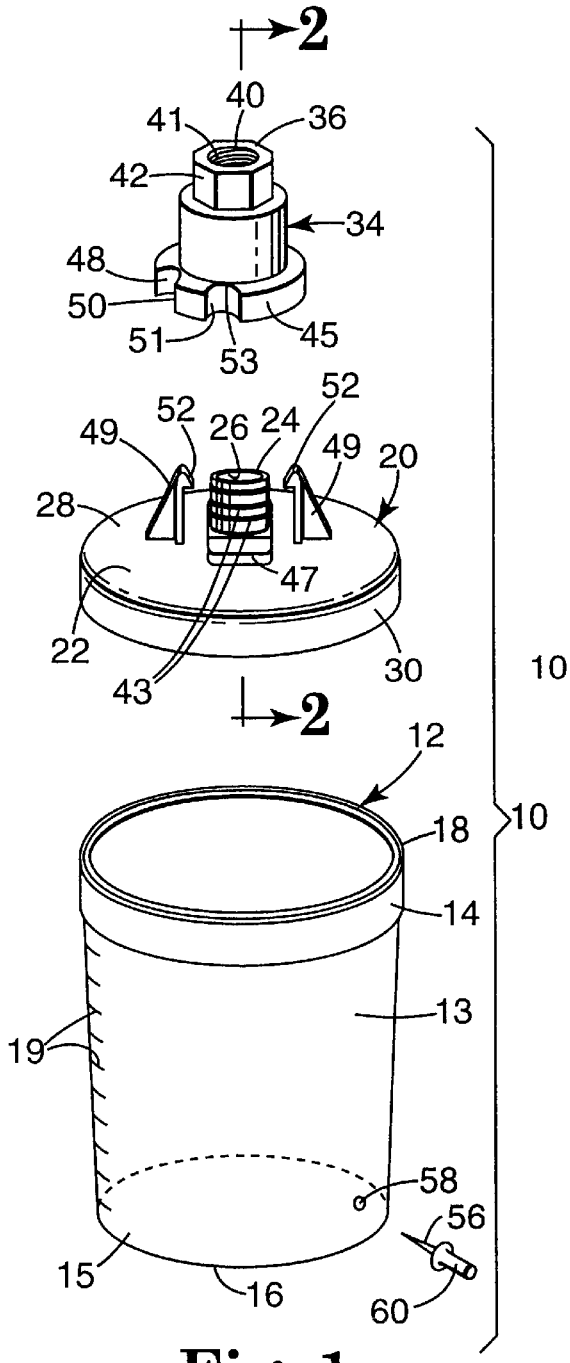
FIG. 1 is an exploded perspective view of a liquid supply assembly according to the present invention.
Figure 3:
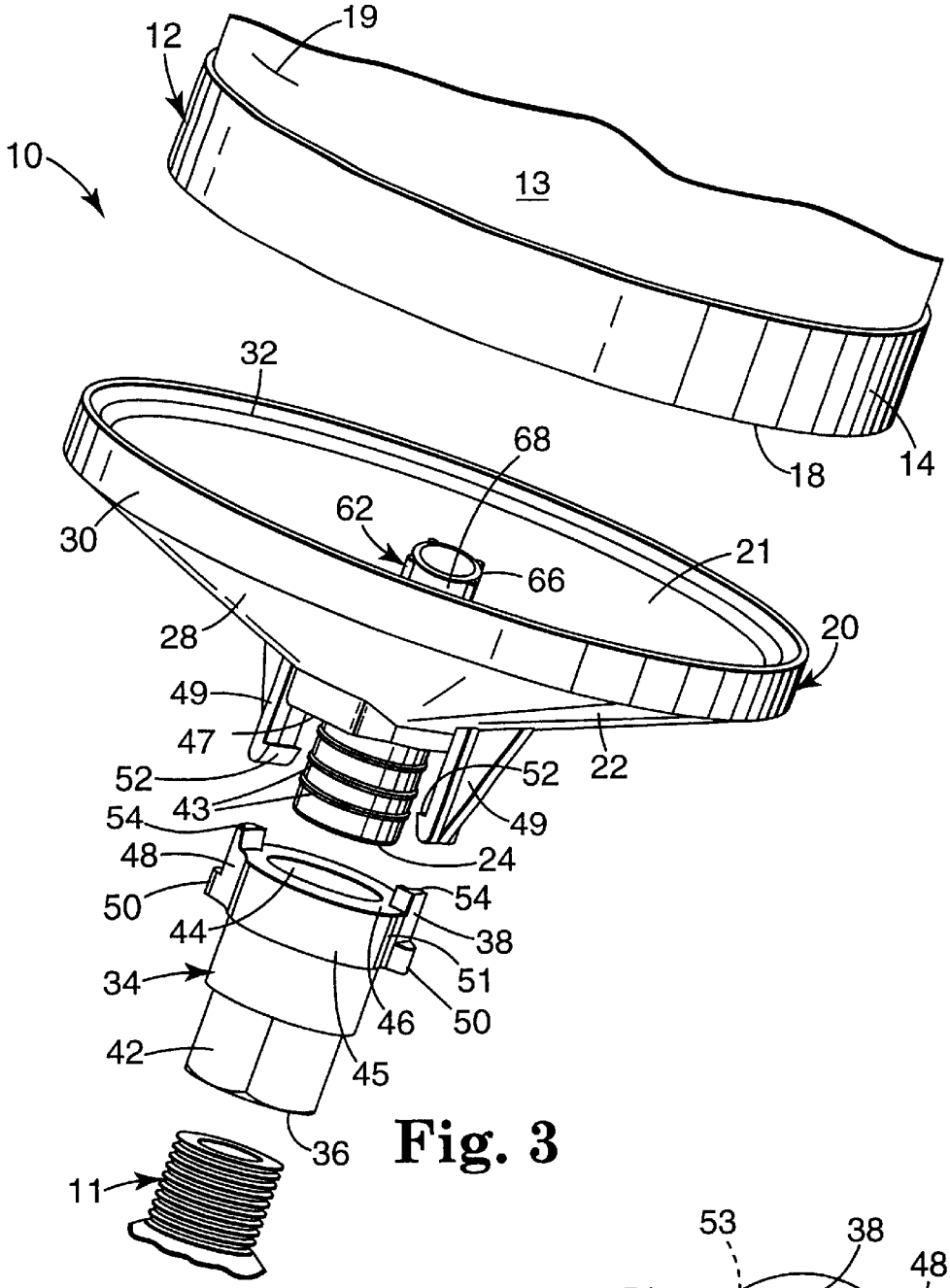
FIG. 3 is an enlarged exploded perspective view of the liquid supply assembly of FIG. 1 together with a fragment of a spraying device or spray gun to which the liquid supply assembly is adapted to be attached.

As is best seen in FIGS. 1 and 3, the liquid supply assembly 10 includes a conventional paint mixing cup 12 of stiff polymeric material (e.g., the polyethylene mixing cups commercially available from PPG, Cleveland, Ohio, which can be obtained in 8 ounce or 240 ml, or 16 ounce or 480 ml, or 24 ounce or 720 ml, or 32 ounce or 960 ml sizes). The paint mixing cup comprises a generally cylindrical side wall 13 having top and bottom ends 14 and 15, a bottom wall 16 extending across and closing the bottom end 15 of the side wall 13, and an outwardly projecting lip 18 around the top end 14 of the side wall 13. The top end 14 of the side wall 13 defines an opening into the cup 12. The side wall 13 bears indicia 19 indicating the levels to which two or three different liquids should be sequentially poured into the cup 12 through that opening to provide a predetermined ratio between those liquids, that indicia 19 being provided for a plurality of different ratios. The side wall 13 is sufficiently translucent to afford seeing the liquid level in the cup 12 through the side wall 13 which assists a person in adding liquids to the desired levels indicated by the indicia 19.

Figure 2:
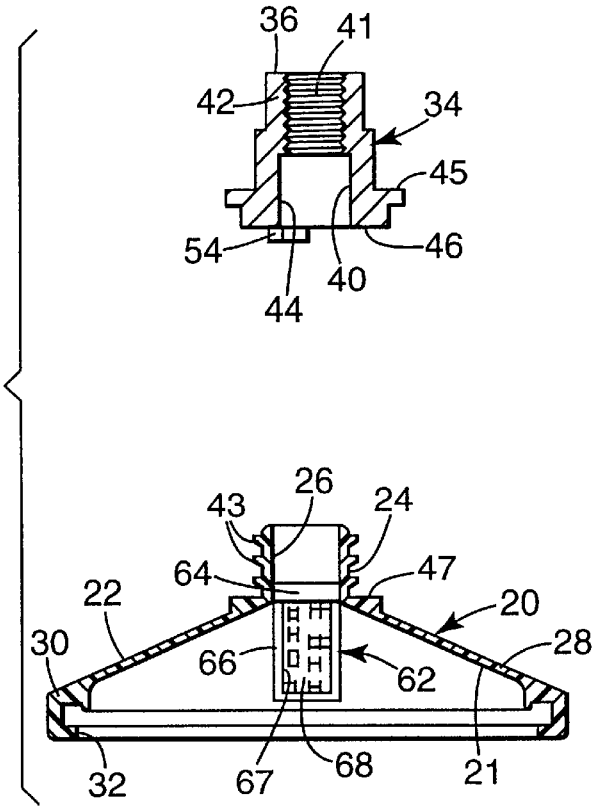
FIG. 2 is an enlarged sectional view taken approximately along section line 2—2 of FIG. 1.

The liquid supply assembly 10 also includes a first adapter 20, (see FIGS. 1, 2, and 3) preferably molded of polymeric material (e.g., polyethylene), having opposite inner and outer major surfaces 21 and 22. The first adapter 20 comprises a central generally cylindrical projecting portion 24 having a through opening 26 and a transverse portion 28 including a peripheral part 30. The transverse portion 28 defines a groove 32 along its inner surface that is adapted for sealing engagement with the top end 14 and outwardly projecting lip 18 of the paint mixing cup 12.

A second adapter 34 (see FIGS. 1, 2, 3, and 4), also included in the liquid supply assembly 10, is preferably of metal (e.g., aluminum), has first and second spaced end portions 36 and 38, and has a through opening 40 extending through those end portions 36 and 38. The first end portion 36 of the second adapter 34 has internal threads 41 and six flatted wrench engageable surface portions 42 around its periphery, thereby being adapted to be releasably engaged with external threads on the inlet port of the gravity feed spray gun 11. The first adapter 20 and the second end portion 38 of the second adapter 34 have connector parts that are adapted for releasable liquid tight engagement with their through openings 26 and 40 in communication. Those connector parts include axially spaced radially outwardly projecting sealing rings 43 along the outer surface of the cylindrical portion 24, and a cylindrical inner surface 44 of the second adapter 34 that defines a cylindrical bore opening through the end of the second adapter 34 opposite the threads 41. That bore is adapted to receive the cylindrical portion 24 of the of the first adapter 20 in an engaged position with the sealing rings 43 in slightly compressed liquid tight engagement with the inner surface 44 defining the bore and with an end surface 46 on a collar 45 around the second end portion 38 of the second adapter 34 abutting a boss 47 in the first adapter 20 around the cylindrical portion 24. The collar 45 has major cylindrically concave recesses 48 along opposite sides of its periphery (see "FIG. 4) adapted to pass the distal ends of hook members 49 projecting from the transverse portion 28 of the first adapter 20 on opposite sides of the cylindrical portion 24 when the cylindrical portion 24 is pressed axially into the bore with the first and second adapters 20 and 34 in a first relative position at which the hook members 49 are aligned with the major recesses 48 in the collar 45. The first and second adapters 20 and 34 can then be rotated relative to each other to a second relative position to cause the resiliently flexible projecting hook members 49 to be deflected outwardly by, and to move around, cylindrically convex cam lobes 50 projecting radially outwardly on corresponding sides of the major recesses 48 until the projecting hook members 49 are positioned in minor cylindrically concave recesses 51 in the collar 45 at which opposed inwardly projecting lips 52 on the distal ends of the projecting hook members 49 are engaged over a surface 53 of the collar 45 adjacent the first end 36 of the second adapter 34. Lugs 54 projecting axially past the end surface 46 of the collar 45 are adapted to move between positions engaging sides of the boss 47 on the first adapter 20 when the cylindrical portion 24 is in its engaged position in the bore defined by the inner surface 44, thereby limiting relative movement between the adapters 20 and 34 to movement to and between those first and second relative positions.

The liquid supply assembly 10 further includes a tapered, pointed, removable pin 56 (e.g., a pin of the type sometimes called a "push pin") extending through a passageway 58 in the side wall 13 of the cup 12 adjacent its bottom wall 16 (see FIGS. 1 and 5). On the end of the pin 56 opposite its point is a molded head 60 by which the pin 56 can be manually pressed through the side wall 13 to form the passageway 58. When the cup 12 is inverted to supply liquid to the spray gun 11 as is illustrated in FIG. 6, the pin 56 can be removed so that the passageway 58 will provide vacuum relief for the cup 12 by then allowing air to enter the cup 12 through the passageway 58 above the liquid (e.g., paint) being supplied to the spray gun 11. Before and after any such spraying operations that pin 56 may be positioned in the passageway 58 as is illustrated in FIG. 5 to preclude liquid within the cup 12 from leaking through the passageway 58 when the cup is supported on its bottom wall 16.

The combination 10 can also include a removable filter assembly 62 (see FIGS. 2 and 3) of a known commercially available type (e.g., the filter commercially designated "paint filter kit" that is commercially available from Standard Color, St. Paul, Minn.). The filter assembly 62 includes a stiff polymeric frame comprising a cylindrical outlet portion 64 having a cylindrical outer surface frictionally engaged within the inner surface defining the through opening 26 in the central projecting portion 24, which outlet portion 64 has a through opening. The frame of the filter assembly 62 further includes an inlet portion 66 projecting from the inner surface 21 of the transverse portion 28 of the first adapter 20. The inlet portion 66 has four axially extending rectangular inlet passageways 67 spaced around its periphery that communicate with the through opening in the outlet portion 64, and includes a filter screen 68 extending across the inner ends of those inlet passageways 67.

Figure 4:
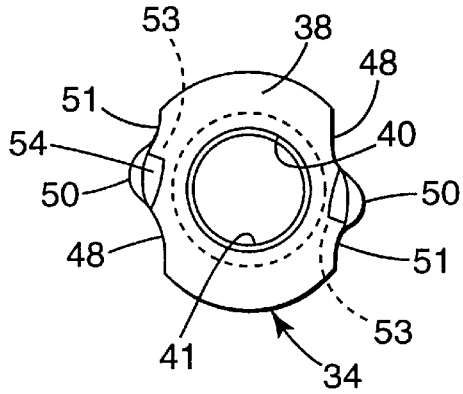
FIG. 4 is an end view of a second adapter included in the liquid supply assembly of FIG. 1.
Figure 7:
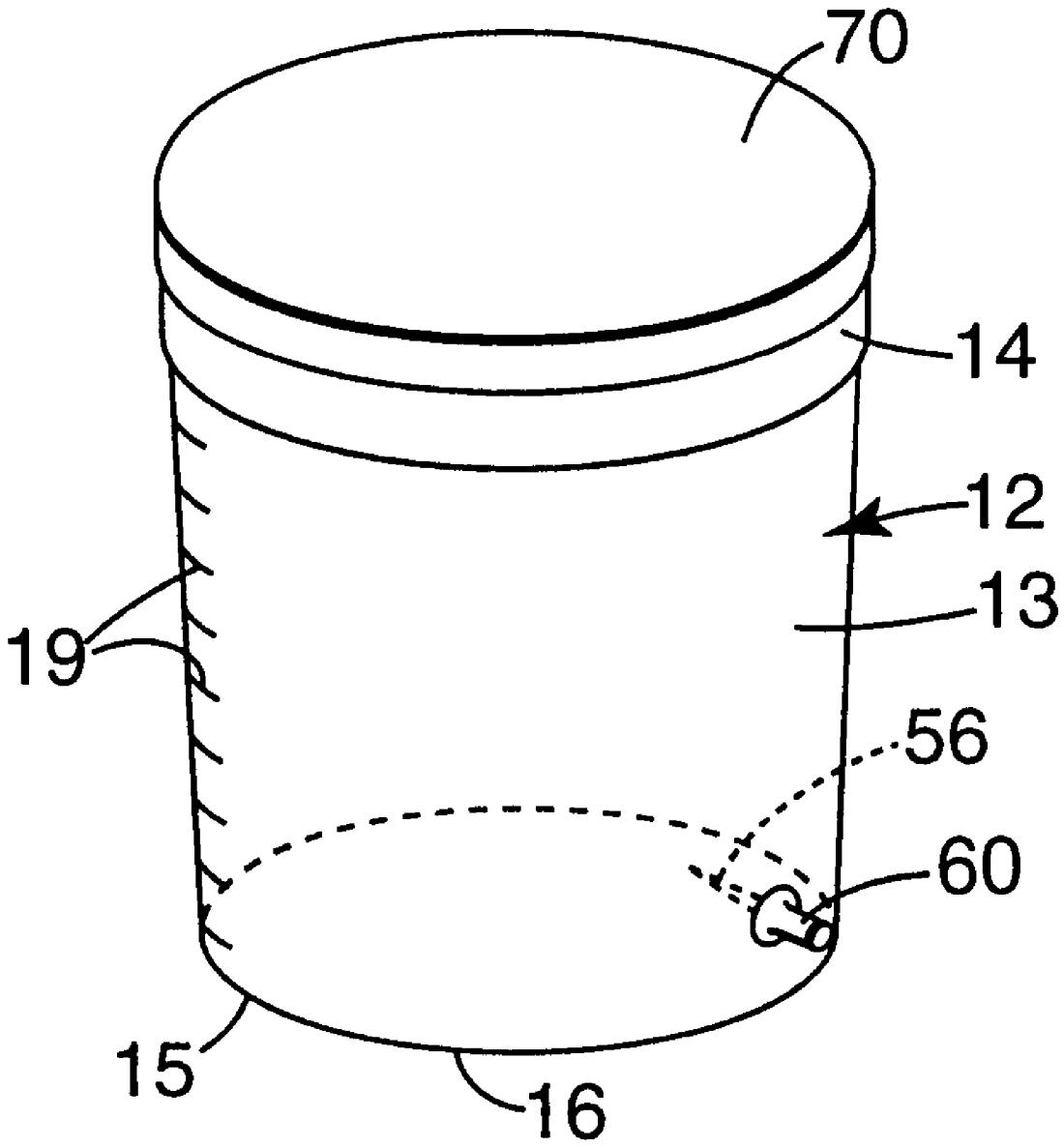
FIG. 7 is a perspective view of a mixing cup included in the liquid supply assembly of FIG. 1, which mixing cup has been separated from the rest of the liquid supply assembly and has had a conventional cover applied to it.

A method according to the present invention for providing a supply of mixed liquids for the gravity fed liquid spraying device 11 includes mixing the liquids in the mixing cup 12 using the indicia 19 to indicate the levels to which the liquids should be sequentially poured into the cup 12 to achieve the desired ratio between the liquids; engaging the peripheral part 30 of the first adapter 20 with the top end 14 of the mixing cup 12 containing the mixed liquids; engaging the first end 36 of the second adapter 34 with the inlet port of the liquid spraying device 11 (if this has not already been done); engaging the connector parts as described above (this being done with the mixing cup supported on its bottom wall and the spraying device inverted as illustrated in FIG. 3); and positioning the spraying device 11 as illustrated in FIG. 4 so that the bottom wall 16 of the mixing cup 12 is uppermost to feed the liquid in the mixing cup 12 to the spraying device 11 through the filter assembly 62 and the openings 26 and 40 in the adapters 20 and 34. That method can further include inserting the tapered pin 56 through the side wall 13 of the mixing cup 12 adjacent its bottom wall 16, and removing the tapered pin 56 from the side wall 13 after the spraying device 11 is positioned with the bottom wall 16 of the mixing cup 12 uppermost as illustrated in FIG. 4 to feed the liquid in the mixing cup 12 to the spraying device. Such insertion of the tapered pin 56 provides the passageway 58 through the side wall 13 of the mixing cup 12 adjacent its bottom wall 16 so that air can flow into the cup 12 through the passageway 58 as the liquid is sprayed to restrict causing a vacuum in the mixing cup 12. If liquid remains in the mixing cup 12 after use of the liquid spraying device 11, the pin 56 can be inserted through the passageway 58 to restrict leakage of liquid through the passageway 58; the spraying device 11 can again be inverted to the position illustrated in FIG. 3, the connector parts can be disconnected, the first adapter 20 can be removed from the top end 14 of the mixing cup 12 containing the remaining liquid; a conventional cover 70 (see FIG. 7) can be applied to the top end 14 of the mixing cup 12, and the remaining liquid can be stored for future use in the covered mixing cup 12. The inexpensive first adapter 20 and the filter assembly 52 can then be disposed of so that cleanup of the liquid supply assembly 10 only requires cleaning the second adapter 34, which is cleaned with the spray gun 11.

The present invention has now been described with reference to one embodiment thereof. It will be apparent to those skilled in the art that many changes can be made in the embodiment described without departing from the scope of the present invention. For example, any of a number of different types of connectors can be used between the adapters 20 and 34. Thus, the scope of the present invention should not be limited to the structures and methods described in this application, but only by the structures and methods described by the language of the claims and the equivalents thereof.

What is claimed is:

1. An assembly for connecting a liquid supply to an inlet port on a gravity fed liquid spraying device, said assembly comprising:

a first adapter having first and second end portions and a through opening extending through said end portions, said first end portion of said first adapter including means for communicating with the liquid supply;

a second adapter having first and second end portions, and a through opening extending through said end portions of said second adapter, said first end portion of said second adapter including means for engaging the inlet port of the gravity feed spray gun;

the second end portions of the adapters having connector parts adapted for releasable liquid tight engagement with the through openings in the adapters in communication;

said connector parts on said first adapter including a projecting portion having an outer surface and axially spaced proximal and distal ends, and projecting resiliently flexible hook members on opposite sides of the projecting portion, said hook members having distal ends and opposed radially inwardly projecting lips on said distal ends; and said connector parts on said second adapter including an inner surface in the second end portion of the second adapter defining a bore opening through the end of the second adapter and adapted to receive the projecting portion of the of the first adapter in an engaged position with the outer surface of the projecting portion in liquid tight engagement with the inner surface, and a collar around the second end portion of the second adapter, said collar having major recesses along opposite sides adapted to pass the distal ends of the projecting hook members of the first adapter when the projecting portion is pressed axially into the bore with the first and second adapters in a first relative position at which the hook members are aligned with the major recesses in the collar, said collar having retaining surfaces facing the first end of the second adapter extending along corresponding sides of said major recesses, and said first and second adapters being rotatable relative to each other to a second relative position when said adapters are in said first relative position to cause the lips on hook members to be engaged with said retaining surfaces on the collar, said collar including cam lobes projecting radially outwardly on corresponding sides of the major recesses, and minor recesses in the collar on the sides of the cams opposite the major recesses, said retaining surfaces extending along said second recesses, and rotation of said first and second adapters to said second relative position causing the resiliently flexible projecting hook members to be deflected radially outwardly by, and to move around said cam lobes until the projecting hook members are positioned in said minor recesses in the collar at which position said Inwardly projecting lips on the distal ends of the projecting book members are engaged with said retaining surfaces of the collar.

2. An assembly according to claim 1, further including the liquid supply, said liquid supply comprising a mixing cup of stiff polymeric material comprising a side wall having top and bottom ends, and a bottom wall extending across and closing the bottom end of said side wall, said top end of said side wail defining an opening into said cup, and said side wall bearing indicia indicating the levels to which a plurality of different liquids can be sequentially pound into the cup to achieve a predetermined ratio between the liquids;

said means on said first end portion of said second adapter for communicating with the liquid supply comprises a transverse portion of said second adapter including a peripheral part defining a groove receiving said top end of said mixing cup in sealing engagement with said peripheral part; and said assembly further includes a tapered removable pin extending through said side wall of said mixing cup adjacent said bottom wall, said pin having been pressed through the side wall to form a passageway through the side wall, being positioned in the passageway to restrict any liquid in the mixing cup from moving through the passageway, being removable from the passageway to allow air to move through the passageway into the mixing cup adjacent said bottom wall, and after such removal being again positionable in the passageway to again restrict any liquid in the mixing cup from moving through the passageway.

3. An assembly according to claim 1, wherein said first adapter is of polymeric material, said projecting portion of said first adapter includes axially spaced radially outwardly projecting scaling rings along said outer surface, said first adapter has a boss around the proximal end of the projecting portion, and in said engaged position the sealing rings are in slightly compressed liquid tight engagement with the inner surface, and the collar around the second end portion of the second adapter has an end surface abutting the boss of the first adapter.

4. An assembly for use on a gravity fed liquid spraying device having an inlet port, said assembly comprising:

a mixing cup of stiff polymeric material comprising a side wall having top and bottom ends, and a bottom wall extending across and closing the bottom end of said sidewall, said top end of said side wall defining an opening into said cup, and said side wall bearing indicia indicating the levels to which a plurality of different liquids can be sequentially pawed into the cup to achieve a predetermined ratio between the liquids;

an adapter assembly for connecting the mixing cup to the inlet port on the gravity fed liquid spraying device, said adapter assembly comprising:

a first adapter having first and second end portions and a through opening extending through said end portions of said first adapter, said first end portion of said first adapter comprising a transverse portion including a peripheral part defining a groove along said inner major surface receiving aid lop end of said mixing cup in sealing engagement with said peripheral part;

a second adapter having first and second end portions, and a through opening extending through said end portions of said second adapter, said first end portion of said second adapter including means for engaging the inlet port of the gravity feed spray gun;

the second end portions of the adapters having connector parts adapted fir releasable liquid tight engagement with the through openings in the adapters in communication;

said connector parts on said first adapter including a projecting portion having a cylindrical outer surface, axially spaced proximal and distal ends, and axially spaced radially outwardly projecting sealing rings along said cylindrical outer surface, a boss around the proximal end of the projecting portion, and projecting resiliently flexible hook members on opposite sides of the projecting portion, said hook members having distal ends and opposed radially inwardly projecting lips on said distal ends; and said connector parts on said second adapter including a cylindrical inner surface in the second end portion of the second adapter defining a bore opening through the end of the second adaptor and adapted to receive the projecting portion of the of the first adapter in an engaged position with the sealing rings in slightly compressed liquid tight engagement with the inner surface, and a collar around the second end portion of the second adapter having an end surface adapted to abut the boss of the first adapter when the projecting portion of the first adapter is in said engaged position, said collar having major recesses along opposite sides adapted to pass the distal ends of the projecting hook members of the first adapter when the projecting portion is pressed axially into the bore with the first and second adapters in a first relative position at which the hook members are aligned with the major recesses in the collar, said collar having retaining surfaces facing the first end of the second adapter and extending along corresponding sides of said major recesses, and said first and second adapters being rotatable relative to each other to a second relative position when said adapters are in said first relative position to cause the lips on hook members to be engaged with the retaining surfaces on the collar, said collar including cam lobes projecting radially outwardly on corresponding sides of the major recesses, and minor recesses in the collar on the sides of the cams opposite the major recesses, said retaining surfaces are along said second recesses, and rotation of said first and second adapters to said second relative position causes the resiliently flexible projecting hook members to be deflected outwardly by, and to move around said camobes until the projecting hook members are positioned in said minor recesses in the collar at which said inwardly projecting lips on the distal ends of the projecting hook members arc engaged over said retaining surfaces of the collar;

said assembly further including a tapered removable pin extending through said side wall of said mixing cup adjacent said bottom wall, said pin having been pressed through the side wall to form a passageway through the side wall, being positioned in the passageway to restrict any liquid in the mixing cup from moving through the passageway, being removable from the passageway to allow air to move through the passageway into the mixing cup adjacent said bottom wall, and after such removal being again positionable in the passageway to again restrict any liquid in the mixing cup from moving through the passageway.

5. An assembly for use on a gravity fed liquid spraying device having an inlet port, said assembly comprising: a container of polymeric material having a portion defining an inlet opening; an adapter assembly for connecting the container to the inlet port on the gravity fed liquid spraying device, said adapter assembly comprising: a first adapter of polymeric material having first and second end portions and a through opening extending trough said end portions of said first adapter, said first end portion of said first adapter comprising a transverse portion including a peripheral part; means for releasably attaching said container to said peripheral part with said portion defining said inlet opening in sealed engagement with said peripheral part; a second adapter having first and second end portions, and a through opening extending through said end portions of said second adapter, said first end portion of said second adapter including means for engaging the inlet port of the gravity feed spray gun; the second end portions of the adapters having connector parts adapted for releasable liquid tight engagement with the through Openings in the adaptors in communication; said connector parts on said first adapter including a projecting portion having an outer surface, axially spaced proximal and distal ends, and axially spaced radially outwardly projecting sealing rings along said outer suffice, a boss around the proximal end of the projecting portion, and projecting resiliently flexible hook members on opposite sides of the projecting portion, said book members having distal ends and opposed radially inwardly projecting lips on said distal end,; and maid connector parts on said second adapter including a cylindrical inner surface in the second end portion of the second adapter defining a bore opening through the end of the second adapter and adapted to receive the projecting portion of the of the first adapter in an engaged position with the sealing rings in slightly compressed liquid tight engagement wit the inner surface, and a collar around the second end portion of the second adapter having an end surface adapted to abut the boss of the first adapter when the projecting portion of the first adapter is in said engaged position, said collar having major recesses along opposite sides adapted to pass the distal ends of the projecting hook members of the first adapter when the projecting portion is pressed axially into the bore with the first and second adapters in a first relative position at which the book members are aligned with the major recesses in the collar, said collar having retaining surfaces facing the first end of the second adapter and extending along corresponding sides of said major recesses, and said first and second adapters being rotatable relative to each other to a second relative position when said adapters are in said first relative position to cause the lips on hook members to be engaged with the retaining surfaces on the collar.

* * * * *

UNITED STATES PATENT AND TRADEMARK OFFICE

CERTIFICATE OF CORRECTION

PATENT NO. : 6,595,441 B2
DATED : July 22, 2003
INVENTOR(S) : Petrie, Robert M.

It is certified that error appears in the above-identified patent and that said Letters Patent is hereby corrected as shown below:

Title page,
Item [56], References Cited, U.S. PATENT DOCUMENTS, delete "Nelburg" and insert in place thereof -- Neiburg --.

Column 6,
Line 25, delete "Inwardly" and insert in place thereof -- inwardly --.
Line 26, delete "book" and insert in place thereof -- hook --.
Line 33, delete "wail" and insert in place thereof -- wall --.
Line 35, delete "pound" and insert in place thereof -- poured --.
Line 58, delete "scaling" and insert in place thereof -- sealing --.

Column 7,
Line 2, delete "sidewall" and insert in place thereof -- side wall --.
Line 5, delete "pawed" and insert in place thereof -- poured --.
Line 15, delete "aid lop" and insert in place thereof -- said top --.
Line 24, delete "fir" and insert in place thereof -- for --.
Line 39, delete "adaptor" and insert in place thereof -- adapter --.

Column 8,
Line 2, delete "camobes" and insert in place thereof -- cam lobes --.
Line 5, delete "arc" and insert in place thereof -- are --.
Line 24, delete "trough" and insert in place thereof -- through --.
Line 36, delete "Openings" and insert in place thereof -- openings --.
Line 36, delete "adaptors" and insert in place thereof -- adapters --.
Line 39, delete "suffice" and insert in place thereof -- surface --.
Line 42, delete "book" and insert in place thereof -- hook --.
Line 44, delete "end,;" and insert in place thereof -- ends; --.
Line 44, delete "maid" and insert in place thereof -- said --.

UNITED STATES PATENT AND TRADEMARK OFFICE

CERTIFICATE OF CORRECTION

PATENT NO. : 6,595,441 B2
DATED : July 22, 2003
INVENTOR(S) : Petrie, Robert M.

It is certified that error appears in the above-identified patent and that said Letters Patent is hereby corrected as shown below:

Column 8 (cont'd),
Line 50, delete "wit" and insert in place thereof -- with --.
Line 59, delete "book" and insert in place thereof -- hook --.

Signed and Sealed this

Twenty-eighth Day of September, 2004

JON W. DUDAS
*Director of the United States Patent and Trademark Office*